United States Patent [19]

Toot

[11] Patent Number: 4,827,956

[45] Date of Patent: May 9, 1989

[54] REMOTE GRASPING DEVICE

[76] Inventor: William W. Toot, RD 2-Box 160, Rome, Pa. 18837

[21] Appl. No.: 127,152

[22] Filed: Dec. 1, 1987

[51] Int. Cl.[4] ..... A45B 3/00

[52] U.S. Cl. ..... 135/66; 294/86.14

[58] Field of Search ..... 135/66, 65; 294/86.14

[56] References Cited

U.S. PATENT DOCUMENTS

| | | | |
|---|---|---|---|
| 2,061,864 | 11/1936 | Wells | 294/86.14 |
| 2,346,901 | 4/1944 | Branden | 294/86.14 |
| 3,093,402 | 6/1963 | Sisson | 135/66 X |
| 3,467,116 | 9/1969 | Ringewaldt | 135/66 X |

FOREIGN PATENT DOCUMENTS

| | | | |
|---|---|---|---|
| 76269 | 4/1919 | Australia | 294/86.14 |
| 2626544 | 12/1977 | Fed. Rep. of Germany | 135/66 |
| 3412339 | 10/1984 | Fed. Rep. of Germany | 135/66 |

*Primary Examiner*—J. Karl Bell

*Attorney, Agent, or Firm*—Lawrence P. Kessler

[57] ABSTRACT

A remote grasping device of simplified construction which requires little operator strength or manual dexterity. The device associated with a walking aid includes a pair of opposed jaw-like gripping members and a mechanism for selectively urging the members toward one another to an article grasping position or apart to an article release position. A reversible motor is operatively associated with the urging mechanism, and a remote switch is provided for activating the motor to operate the motor in a direction to effect urging of the members in a desired direction.

4 Claims, 2 Drawing Sheets

REMOTE GRASPING DEVICE

BACKGROUND OF THE INVENTION

This invention relates in general to grasping devices, and more particularly to a grasping device which is associated with a walking aid and is remotely actuated from the handle of such aid.

When a person is incapacitated due to illness, injury, or merely advanced age, it often occurs that such person is unable to perform certain menial tasks which are normally taken for granted. Of particular concern is the picking up, or grasping of articles of immediate necessity when no one else is arround to render aid or assistance. Moreover, simply being able to accomplish the pickup or grasping of desired articles for one's self enables that person to establish a certain degree of independence and self-esteem. This is highly beneficial for improving both the physical and mental health of such person.

In an effort to provide the ability to pick up or grasp articles, various devices have been proposed. Typical of such devices is a mechanical claw-like mechanism where the jaws thereof are manually actuated from a remote location, by, for example, a complex extension linkage. However, such mechanical type mechanisms may require a degree of strength and/or dexterity that the operator is not capable of performing.

SUMMARY OF THE INVENTION

This invention is directed to a remote grasping device associated with a walking aid of simplified construction which requires little operator strength or manual dexterity. The device includes a pair of opposed jaw-like gripping members and a mechanism for selectively urging the members toward one another to an article grasping position or apart to an article release position. A reversible motor is operatively associated with the urging mechanism, and a remote switch is provided for activating the motor to operate the motor in a direction to effect urging of the members in a desired direction. In a preferred embodiment according to this invention, the device is adapted to be removably associated with any suitable elongated member so as to remotely space the jaw-like members from the activating switch whereby articles otherwise out of the range of the operator can be reached. In another preferred embodiment according to this invention, the device is integrally formed with an elongated member such as a walking aid or cane for example.

The invention, and its objects and advantages. will become more apparent in the detailed description of the preffered embodiments presented below.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENTS

Figure 1:
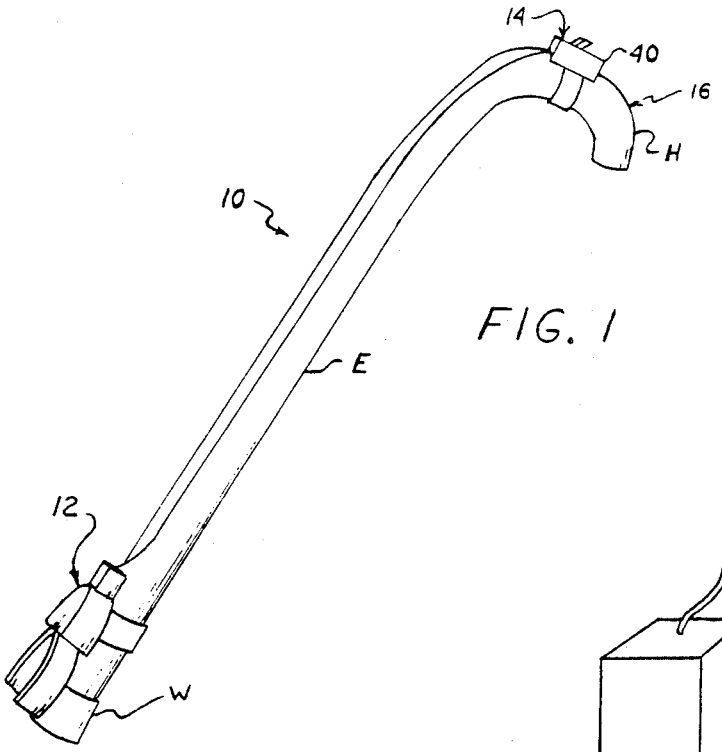
FIG. 1 is a view, in perspective, of the remote grasping device according to this invention.

Referring now to the accompanying drawings, FIG. 1 shows a preferred embodiment of the remote grasping device, designated by the numeral 10, according to this invention. The device 10 includes a grasping mechanism 12 and a remote activator 14 for such mechanism. The grasping mechanism 12 and the activator 14 are adapted to be removably attachable to a walking air 16, such as a cane for example. Of course, it is within the scope of this invention that the mechanism and activator could be adapted to be integrally mounted on a tubular member of any suitable cross-sectional configuration, and such tubular member could be used as a walking aid.

Figure 5:
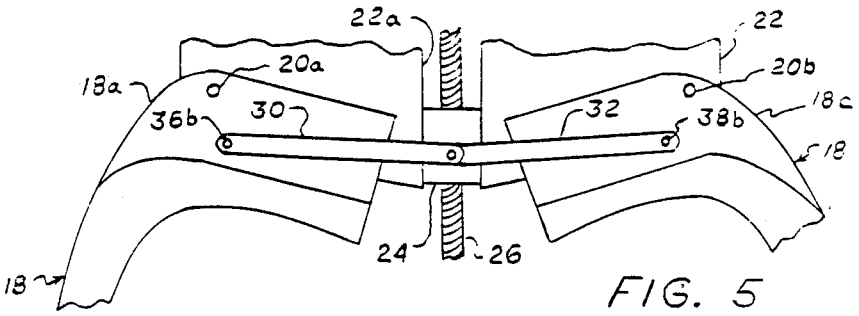
FIG. 5 is a side elevational view of a portion of the opposed jaws and jaw urging mechanism of FIG. 3 in the article-release position.
Figure 4:
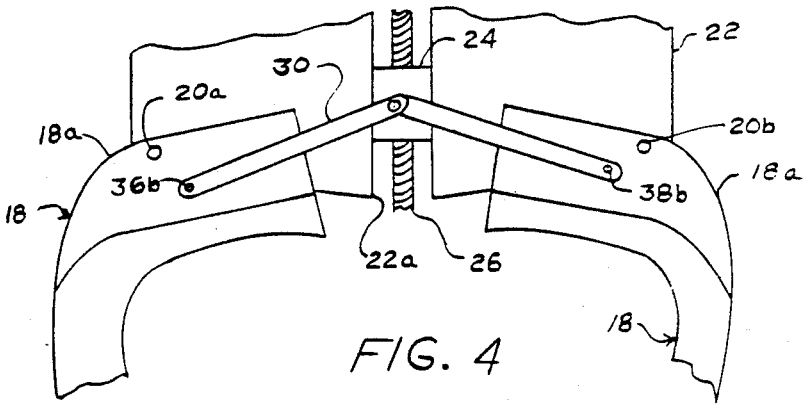
FIG. 4 is a side elevational view of a portion of the opposed jaws and jaw urging mechanism of FIG. 3 in the article-grasping position.
Figure 3:
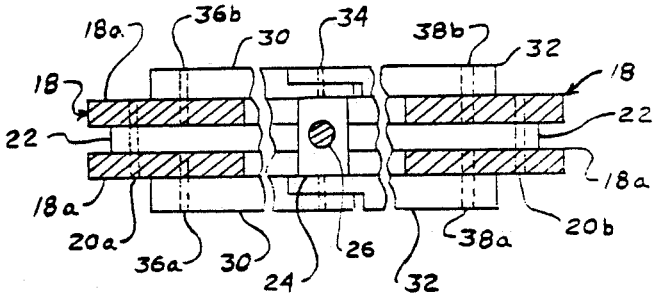
FIG. 3 is a bottom plan view, partly in cross-section and on an enlarged scale, of the opposed jaws and jaw urging mechanism of the device of FIG. 1.

The walking aid 16 comprises a hand engageable portion H, an elongated portion E, and a walking surface engaging portion W. The grasping mechanism 12 (as best shown in FIGS. 3–5) is removably attached to the portion E adjacent to the walking surface engaging portion W. The mechanism 12 includes a pair of opposed jaw-like members 18. Such jaw-like members may be formed with a magnetic material adjacent to the gripping surface thereof in order to attract magnetizable articles to such members. Also a hook-type implememnt (not shown) may be attached to the mechanism 12 to facilitate article retrieval.

Figure 2:
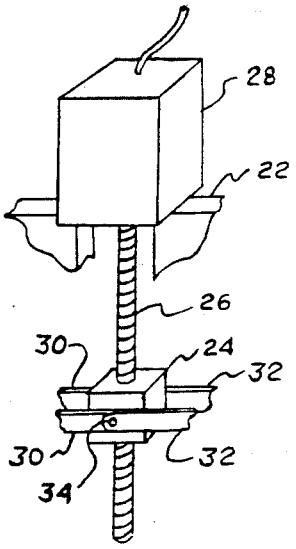
FIG. 2 is a view, in perspective, of the motor and its threaded output shaft for actuating the jaw urging mecanism toward its article-grasping or releasing position.

The members 18 each have a pair of projections **18*a* extending therefrom. The projections 18*a* of the respective members 18 are mounted on pivot shafts 20*a*, 20*b* carried by a support 22. The support 22 has a slot 22*a* defined therein, and in which a block 24 is captured for slidable movement along the longitudinal axis of the slot. In order to effect such slidable movement, the block 24 has a threaded bore 24a which is mated with a compilmentary threaded output shaft of a reversible motor 28 mounted on the support 22** (see FIG. 2).

Pairs of arms 30, 32 are interconnected between the block 24 and respective members 18. The arms are provided to transmit longitudinal movement of the block, along the shaft 26, into pivotal movement of the members about the pivot shafts **20*a*, 20*b*. In order to accomplish this pivoting action, the pairs of arms 30, 32 are pivotally mounted adjacent to one respective end on a pivot pin 34 extending from the block 24. The opposite respective ends of the pairs of arms are pivotally connected by pins 36*a*, 36*b* and 38*a*, 38*b* to the projections 18*a* of the members 18. The respective locations of the pins 36*a*, 36*b* and 38*a*, 38*b* are selected so that longitudinal movement of the block 24 results in a corresponding pivot action of the members 18 about their respective pivot shafts 20*a*, 20*b*. As shown in FIG. 4, when the block 24 moves in a direction toward the motor 28, the members 18 are pivoted toward one another into an article grasping relation. On the other hand, as shown in FIG. 5 when the block 24 moves away from the motor, the members 18** are pivoted away from one another to effect an article release relation.

The longitudinal movement of the block 24 in the guide slot **22*a* of the support 22 for pivoting of the members 18 in the desired direction, is effected by rotation of the output shaft 26 of the reversible motor 28. That is, when the motor rotates the shaft in a first direction, the pitch of the threads of the shaft in the mating threaded bore 24a of the block cause the block to move in a direction away from the motor. Conversely, when the motor rotates in the opposite direction, the pitch of the threads of the shaft in the mating threaded bore 24a** of the block cause the block to move in a direction toward the motor.

The remote activator 14 for the grasping mechanism 12 includes a switch 40. The switch 40 is of any well known double throw type which is located in the path between a source of motive power (such as a battery for example) and the motor 28. Accordingly, the switch can be manually accessed to selectively activate the reversible motor for rotation of the output shaft 26 thereof in either direction. A housing 42, removably connectable to the hand engaging portion H of the walking aid 16, is adapted to contain the switch 40 (and the power source). The switch is therefore readily accessible to the user for selective operation to effect grasping and releasing of an article as desired.

By this invention, there is provided a device of simple construction which is removably attachable to a walking aid, and which is remotely activated so that the user of the walking aid can easily grasp and release articles without requiring substantial strength or manual dexterity.

The invention has been described in detail with particular reference to preferred embodiments thereof, but it will be understood that variations and modifications can be effected within the spirit and scope of the invention.

I claim:

1. A walking aid having an elongated portion and a hard engaging portion, the improvement including a remote grasping device comprising:

a pair of opposed jaw-like gripping members associated with said elongated portion;

means for selectively urging said gripping members together to an article grasping position, or apart to an article release position;

a reversible motor operatively associated with said urging means for actuating said urging means; and switch means, associated with the hand engaging portion, for remotely activating said reversible motor to operate said motor in the appropriate direction to effect desired positioning of said gripping members.

2. The invention of claim 1 wherein said urging means includes a support, means for pivotally attaching said gripping members to said support, and means carried by said support and associated with said reversible motor and said gripping members for pivoting said gripping members on activation of said motor.

3. The invention of claim 2 wherein said means for pivoting said gripping members includes a block guided for slidable movement in a slot defined in said support, said block having a threaded bore complementary to and mating with a threaded output shaft from said reversible motor, and arms extending from said block to said gripping members respectively, whereby rotation of said motor causes longitudinal movement of said block in said slot, and such movement of said block is converted to pivotal movement of said gripping members by said arms.

4. For use with an aid for assisting in walking, said aid including a portion adapted to be grasped by a users hand, an elongated portion, and a portion adapted to engage a walking surface, a remotely activated article grasping device, said device comprising:

a pair of opposed jaw-like gripping members removably connectable to said surface engaging portion of said aid;

means for selectively urging said gripping members together to an article grasping position, or apart to an article release position;

a reversible motor operatively associated with said urging means for actuating said urging means; and switch means for remotely activating said reversible motor to opperate said motor in the appropriate direction to effect desired position of said gripping members, said switch means being removably associated with said user grasping portion of said aid so as to be readily operated by hand.

* * * * *